US006781613B2

(12) United States Patent
Matsuo et al.

(10) Patent No.: US 6,781,613 B2
(45) Date of Patent: Aug. 24, 2004

(54) ELECTRIFICATION APPARATUS AND IMAGE FORMING APPARATUS

(75) Inventors: Minoru Matsuo, Tokyo (JP); Shigeharu Nakamura, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 43 days.

(21) Appl. No.: 10/216,291

(22) Filed: Aug. 12, 2002

(65) Prior Publication Data

US 2003/0030699 A1 Feb. 13, 2003

(30) Foreign Application Priority Data

Aug. 10, 2001 (JP) ..... 2001-243858

(51) Int. Cl.[7] ..... B41J 2/385
(52) U.S. Cl. ..... 347/159
(58) Field of Search ..... 347/228, 140, 347/158, 155, 159; 361/225; 399/168, 175, 50, 315

(56) References Cited

U.S. PATENT DOCUMENTS 5,995,781 A 11/1999 Matsuo
6,072,966 A 6/2000 Matsuo

FOREIGN PATENT DOCUMENTS

| | | | | |
|---|---|---|---|---|
| JP | 6-175502 | * | 6/1994 | ..... G03G/15/09 |
| JP | 7-72714 | * | 3/1995 | ..... G03G/15/02 |
| JP | 2001-166570 | * | 6/2003 | ..... G03G/15/02 |

* cited by examiner

*Primary Examiner*—Hai Pham
(74) *Attorney, Agent, or Firm*—Oblon, Spivak, McClelland, Maier & Neustadt, P.C.

(57) ABSTRACT

Disclosed are an electrification apparatus and an image forming apparatus which reduce ozone generation, provide uniform electrification of a photosensitive body, and have high durability. This electrification apparatus comprises: a first magnet means composed of a magnetized base body obtained by magnetizing a base body of the photosensitive body drum or a magnet configured inside of the base body of the photosensitive body drum; a second magnet means magnetically levitated outside of the photosensitive body drum by the first magnet means; and a discharge electrode firmly attached to a face of the second magnet means opposed to the photosensitive body surface, the discharge electrode having a predetermined distance to the photosensitive body surface.

6 Claims, 9 Drawing Sheets

ELECTRIFICATION APPARATUS AND IMAGE FORMING APPARATUS

BACKGROUND OF THE INVENTION

1. Field of the Invention

The present invention relates to an electrification apparatus and an image forming apparatus such as a copier, facsimile, or printer which uses the electrification apparatus.

2. Description of the Prior Art

In order to form an image by electro-photography, a so-called electrification needs to be performed which positive or negative electric charge is previously applied to a photosensitive body to maintain charge carrier toner.

Conventionally, to implement this electrification, a corona electrification method that uses fine metal wires for corona discharge has been used. This conventional corona electrification method, however, has a problem that ozone generates due to the discharge.

In recent, a contact electrification method is adopted in which a photosensitive body is contacted with toner to be electrified. This contact electrification method uses a charger having a type such as a rotated roller or non-rotating brush, and uses two kinds of electrification methods, that is, an electric charge injection method and a micro gap discharge method, each of which has its own drawbacks and advantages.

These contact electrification methods feature that they perform a discharge or an electric charge injection with a very short distance and thus generate very little ozone during discharge. These methods have, however, the maximum disadvantage due to the use of contact in that, when rotating toner adheres to a photosensitive body to come to an electrification unit and cannot be completely removed, then this toner adheres to the electrification unit and gradually accumulates to deteriorate electrification power or retransfer to the photosensitive body, causing imperfect image.

In order to avoid such an undesirable situation, non-contact type-electrification method is desirable and, in order to minimize the ozone generation, a gap between a photosensitive body and a charger must be reduced.

Nevertheless, in the corona discharge method using fine metal wires, the vibration of the fine metal wires occurs, as can be seen from a careful observation of the discharge by this method.

In a non-contact type-electrification method, its electrification principles are also based on the transfer of corona ions although it uses micro gap. Calculating based on Paschen's law, the method's minimum distance at which discharge starts in an atmospheric pressure is about 70 $\mu$m.

It is difficult, however, for the vibrating wires to assure this distance of 70 $\mu$m throughout the full width of wires, and the center portion of the wire may contact with a photosensitive body. Moreover, such a contact portion with the photosensitive body may cause itself to have short circuiting to damage the photosensitive body, making it impossible to provide uniform electrification on the entire photosensitive body.

There is an attempt in a conventional roller method where end parts of a roller and the like have predetermined thickness to keep such a distance. This attempt has, however, a problem in that when a roller always contacts a photosensitive body to slide with the body, the photosensitive body or the roller oscillating part begins to abrade away, resulting in the loss of an uniform electrification due to the repeated use.

SUMMARY OF THE INVENTION

In view of the above, it is an object of the present invention to provide an electrification apparatus and image forming apparatus that reduce ozone generation, provide uniform electrification of a photosensitive body, and have high durability.

In order to achieve the above object, the present invention provides an electrification apparatus for providing electrification to a photosensitive body in electro-photography. The electrification apparatus comprises a first magnet means composed of a magnetized base body obtained by magnetizing a base body of the photosensitive body or a magnet configured inside of the base body of the photosensitive body; a second magnet means magnetically levitated by the first magnet means outside of the photosensitive body; and a discharge electrode firmly attached to a face of the second magnet means opposed to a photosensitive body surface. The discharge electrode has a predetermined distance from the photosensitive body surface.

In this structure, the magnets which have the same magnetic poles as those of the magnet provided inside of the photosensitive body or the magnetized base body are used with opposed configuration so that the repulsive force by the magnets can levitate the attached discharge electrode, thereby providing non-contact electrification. Moreover, this structure further comprises the discharge electrode firmly attached to a face of the second magnet means opposed to the photosensitive body surface, the discharge electrode having a predetermined distance from the photosensitive body surface, thereby avoiding the vibration of the discharge electrode.

The electrification apparatus according to the present invention is characterized in that the second magnet means comprises regulation means for regulating a magnetic pole direction of the second magnet means and a magnetic pole direction of the first magnet means so that these directions do not deviate from each other.

In this structure, the second magnet means provided outside of the photosensitive body has repulsion with the magnet inside of the photosensitive body or the magnetized base body. The opposite magnetic pole of the second magnet means is, however, drawn by the regulation means, thereby avoiding a rotation of the second magnet means. This allows the second magnet means to keep levitating with a constant distance.

The electrification apparatus according to the present invention is characterized in that the photosensitive body has an opening at least at its end. A support member is provided via the opening for fixedly supporting the first magnet means against a rotation of the photosensitive body.

In this structure, the support member fixedly supports the first magnet means on the photosensitive body and thus avoids the fluctuation of the levitating second magnet means to keep a constant distance between the magnets, thereby providing uniform discharge.

The electrification apparatus according to the present invention is characterized in that the first magnet means is positioned on a vertical line running through a rotation axis of the photosensitive body.

Since the first magnet means serves to levitate the second magnet means, the second magnet means is desirably provided on the vertical line. To do so, it is appropriate to provide the first magnet means at a position above the rotating photosensitive body.

The electrification apparatus according to the present invention is characterized in that the first magnet means is attached to elevation means.

In this structure, the levitation distance of the second magnet means is determined by the magnetic flux density (i.e., magnetic field intensity) of the first magnet means inside of the photosensitive body and the weight and magnetic flux density of the second magnet means outside of the photosensitive body. Constant intensity of electrification of an electrification unit requires minute adjustment of the distance between the photosensitive body surface and the second magnet means. This distance can be adjusted by vertically moving the first magnet means. Thus, the longitudinally movable installation of the first magnet means enables the intensity of electrification to be adjusted.

The electrification apparatus according to the present invention is characterized in that the image forming apparatus according to the present invention uses non-magnetic toner as a development agent for developing a latent image of the photosensitive body.

In this structure, in an electro-photography process, toner cleaned after the transfer step must not contact an electrification unit in subsequent processes. However, if insufficiently cleaned magnetic toner is used, this magnet-used electrification method cannot avoid a situation where magnets cause the magnetic toner to be attracted toward the electrification unit, resulting in a contaminated electrification unit which may cause a problem of uneven electrification. Thus, the use of the nonmagnetic toner can minimize uneven electrification.

BRIEF DESCRIPTION OF THE DRAWINGS

FIG. 1 shows one embodiment of an electrification apparatus according to the present invention, in which

FIG. 11 shows a fixed side-magnet of an electrification apparatus showing the fourth embodiment the present invention.

FIG. 13 shows a levitating side-magnet of an electrification apparatus of the fifth embodiment of the present invention.

DETAILED DESCRIPTION OF THE PREFERRED EMBODIMENTS

Figure 1B:
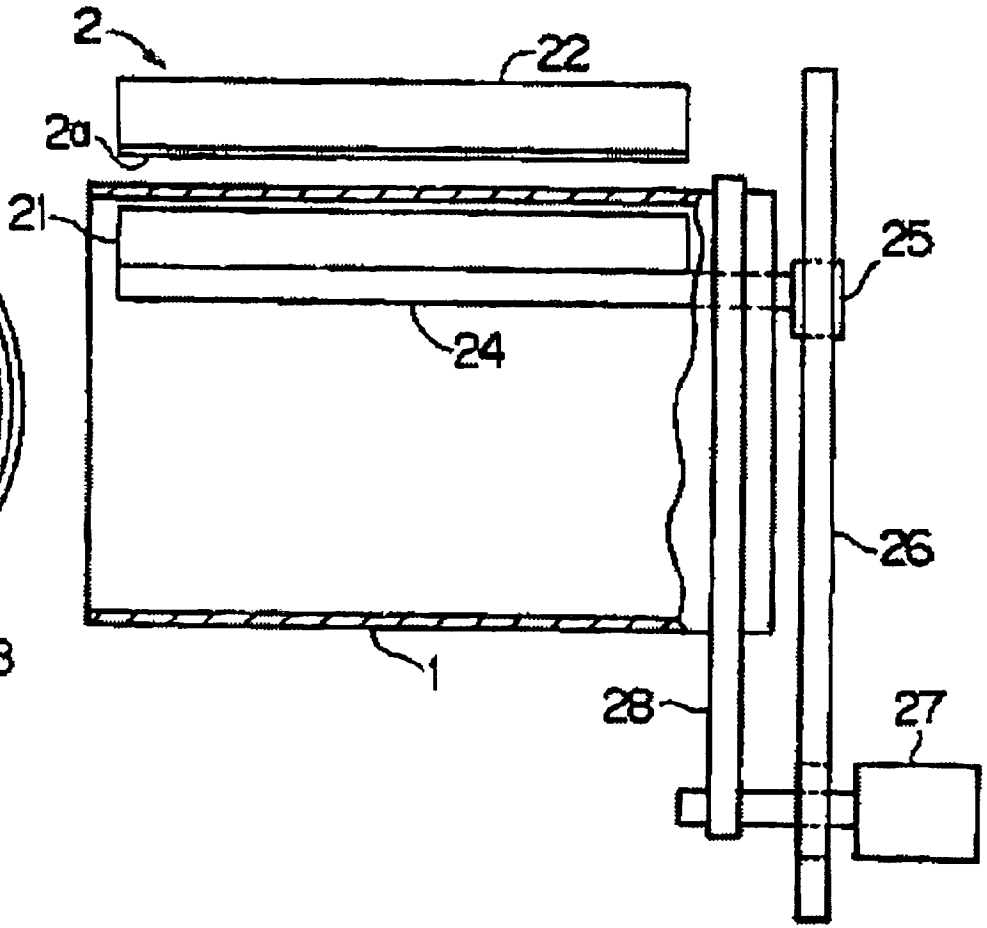
FIG. 1(A) is a side view thereof and FIG. 1(B) is an elevation view thereof.
Figure 1A:
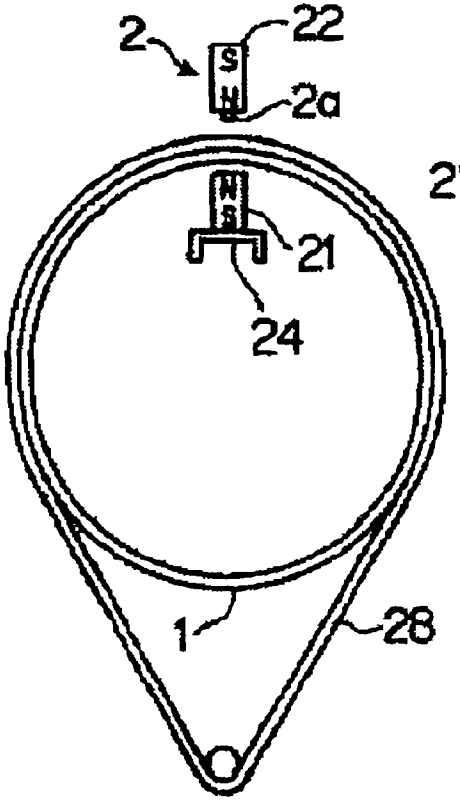

As shown in FIG. 1, an electrification apparatus according to the present invention includes: a first magnet means 21 provided inside of a photosensitive body drum 1 of a hollow cylinder; a second magnet means 22 provided outside of the photosensitive body drum 1; and a discharge electrode 2*a* provided on a face of the second magnet means 22 that is opposed to the photosensitive body drum 1.

The photosensitive body drum 1 is configured such that a driving force from a driving motor 27 is transmitted via a driving belt 28 to the circumference of the photosensitive body drum 1 to allow the photosensitive body drum 1 to rotate. A driving chain may be used in place of the driving belt 28 to transmit a driving force. A flexible belt-shaped photosensitive body may also, be used in place of the photosensitive body dram 1.

As described above, the photosensitive body drum 1 has a hollow cylinder shape in which no metal core bar is provided. In this embodiment, the photosensitive body drum 1 has openings on both ends. From one end opening of the photosensitive body drum 1, a first magnet means support body 24 as a fixation platform is inserted. The first magnet means 21 was attached with this first magnet means support body 24 on an upper face of its tip. This attachment may be provided by forming the first magnet means support body 24 with a magnetic body to fix it by magnetic force of the first magnet means 21 or by using fixation tools such as screws or adhesives.

The first magnet means 21 is positioned on a vertical line running through the rotation center axis of the photosensitive body drum 1. The upper end of the first magnet means 21 is positioned so as not to contact the inner wall of the photosensitive body drum 1. This first magnet means 21 is provided with magnetic poles on its upper and lower ends. In this embodiment, a magnetic pole on the upper end is an N pole and a magnetic pole on the lower end is an S pole.

The first magnet means support body 24 on the proximal end side is attached to a main body side plate 26 via elevation means 25. This elevation means 25 is configured to be capable of rising and falling with respect to the main body side plate 26 and allows the gap between the second magnet means 22 and the surface of the photosensitive body drum 1 to be adjusted.

Figure 2:
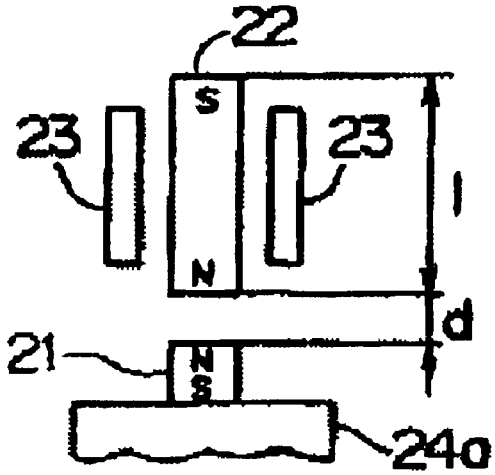
FIG. 2 is a principle view of one embodiment of an electrification apparatus according to the present invention.

FIG. 2 shows a principle of one embodiment of an electrification apparatus according to the present invention.

This electrification apparatus operates based on a principle by which non-contact electrification is provided by providing homopolar magnetic poles such that they are opposed each other in a longitudinal direction with a distance provided therebetween, so that the balance between a repulsive force and gravity causes a discharge electrode to be magnetically levitated.

Using this principle to magnetize these magnets with corresponding gauss amount of magnetization so as to obtain a repulsive force balanced with gravity allows the magnets to be maintained at a predetermined gap.

In other words, as shown in FIG. 2, the second magnet means 22 can be magnetically levitated by a configuration in which the first magnet means 21 is provided on a fixation jig 24*a* such that the N pole of the first magnet means 21 is provided on an upper side thereof and the S pole thereof is provided on a lower side thereof to provide the N pole of the first magnet means 21 opposed to the N pole of the second magnet means 22. The reason why this is possible is that, when homopolar magnetic poles approach each other, repulsive force is generated therebetween. In other words, by adjusting the weight of the second magnet means 22 and the intensities of magnetic poles of the first magnet means 21 and the second magnet means 22, gravity, repulsive force, and attractive force can be balanced as well as the distance d between the magnetic poles can be adjusted. Although this example uses a configuration in which N poles are opposed, another configuration may also be used in which S poles are opposed.

Theoretical conclusion of the above configuration is that, bar-shaped or plate-shaped magnets have a magnetic flux density (G tesla) per weight W (gram) of a unit length. When there is an opposed magnet with magnetic flux density G' tesla, between the same magnetic poles of magnets in parallel, a falling force (i.e., gravity $\mu$g) with a gravity acceleration g, a repulsive force GG'/d at the tip of the magnet, and an attractive force GG'/(d+1) between heteropolars on the other side of the magnet are exerted, and these forces are balanced at a certain point. This distance between balanced magnets can be set at a desired value by selecting any magnetic forces of a fixed magnet and a levitating magnet and the weight of the levitating magnet.

The distance d between magnetic poles is preferably about 5 to 10 mm because a photosensitive body that has a predetermined thickness passes between the first magnet means 21 of fixed side and the second magnet means 22 of levitating side.

As shown in FIG. 2, support side plates 23 are provided in parallel to regulate the inclination of the second magnet means therebetween so that the second magnet means 22 does not rotate or fall down in lateral direction. The reason of this provision is that there are both a repulsive force generated by homopolar magnets and a gravitational force generated by heteropolar magnets between the first magnet means 21 and the second magnet means 22 at the same time. The distances between the support side plates 23 and respective side faces of the second magnet means 22 are preferably made narrow as much as possible, as long as the second magnet means 22 can be longitudinally moved.

Figure 3:
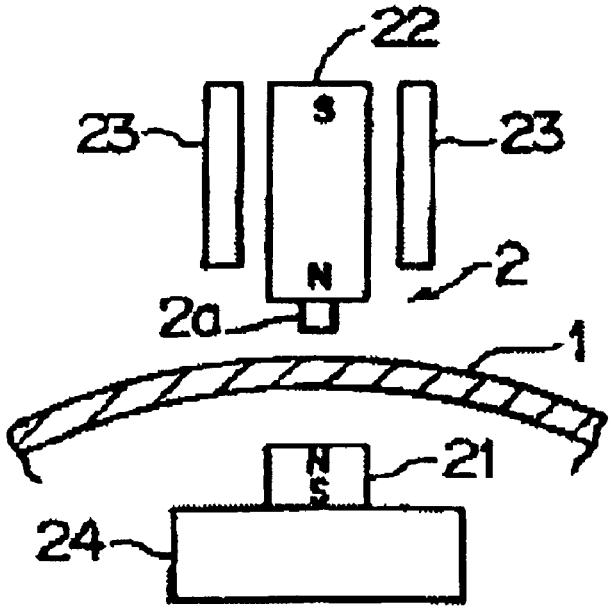
FIG. 3 is a view showing a main part of an electrification apparatus of FIG. 1.

FIG. 3 shows a main part of the electrification apparatus of FIG. 1.

As shown in FIG. 3, the photosensitive body drum 1 is configured between the first magnet means 21 and the second magnet means 22. A base body of this photosensitive body drum 1 consists, in this embodiment, of a non-magnetic body such as an aluminum alloy used in two-component development system. Although these magnets have therebetween a non-magnetic body, repulsive force mainly generated between an N pole of the first magnet means 21 and an N pole of the second magnet means 22 allows the second magnet means 22 to be magnetically levitated. Moreover, the levitating second magnet means 22 has support side plates 23 configured on its both sides, and between the support side plates and the second magnet means, there are gaps, through which the second magnet means 22 can rise and fall.

On the face of the second magnet means 22 that opposes to the surface of the photosensitive body drum, a discharge electrode 2*a* such as a fine wire is closely attached. Such a close contact between the face of the second magnet means 22 and the discharge electrode 2*a* avoids the vibration of the discharge electrode 2*a* due to discharge and the like and keeps a constant micro gap to assure a uniform electrification.

The discharge electrode 2*a* and the second magnet means 22 may also have therebetween an insulator to directly apply voltage to the discharge electrode 2*a*. The discharge electrode 2*a* and the second magnet means 22 may not have therebetween an insulator to have electric connection therebetween, so that via the second magnet means 22 a voltage can be applied to the discharge electrode 2*a*.

The distance between the photosensitive body drum 1 and the discharge electrode 2*a* firmly attached to the levitating second magnet means 22 is preferably about 50 $\mu$m to 0.1 mm so as to avoid the electrification of the photosensitive body surface due to corona discharge and the dissipation of ozone generated by the corona discharge. This distance can be minutely adjusted by providing a spacer between the stationary photosensitive body drum 1 and a discharge electrode (e.g., fine wire) that is attached to the lower end part of the levitating second magnet means 22 to minutely adjust the fixed first magnet means 21 by using the elevation means 25 shown in FIG. 1.

Figure 4:
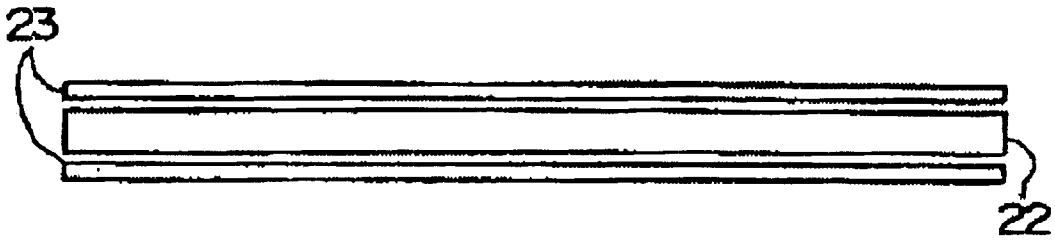
FIG. 4 is a plan view showing a configuration example of a second magnet means and support side plates as regulation plates.

FIG. 4 is a plan view showing a configuration example of a second magnet means and support side plates as regulation plates.

Also can be seen in FIG. 4, in this configuration the support side plates 23 have therebetween the second magnet means 22 in the longitudinal direction. The distance between these support side plates 23 and the second magnet means 22 is sufficient if there is a clearance that assures that the second magnet means 22 can freely move and which is preferably narrow as much as possible so that magnetic lines of force can have reflectional symmetry relation with the first magnet means 21.

Figure 5:
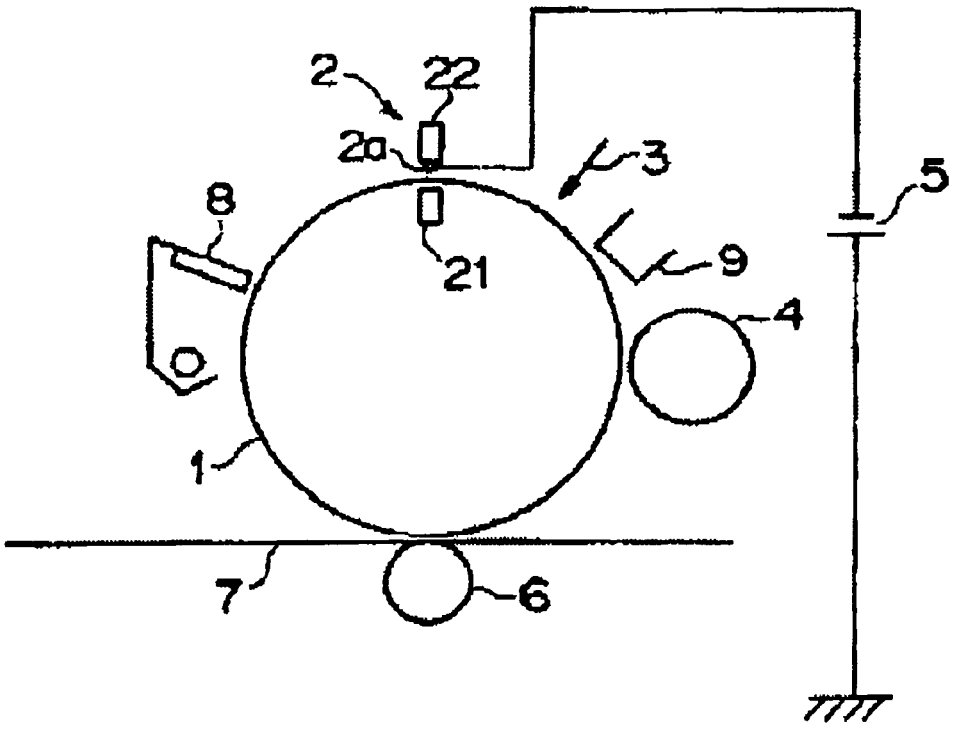
FIG. 5 is a schematic drawing of an image forming apparatus having an electrification apparatus of one embodiment according to the present invention.

FIG. 5 shows an outline of an image forming apparatus having an electrification apparatus according to one embodiment of the present invention.

As shown in FIG. 5, this image forming apparatus having a non-contact type electrification apparatus is composed of: a photosensitive body drum 1 on which an electrostatic latent image is formed; an electrification apparatus 2 for providing an electrification processing to the photosensitive body drum 1 in a non-contact manner; exposure means 3 such as laser light or reflected light from a document; a development roller 4 by which the electrostatic latent image of the photosensitive body drum 1 is adhered with toner; a power pack 5 for applying a DC voltage to the electrification apparatus 2; a transfer roller 6 for processing to transfer the toner image on the photosensitive body drum 1 to a recording paper; a cleaning apparatus 8 for cleaning the transfer-processed photosensitive body drum 1; and a surface electric electrometer 9 for measuring a surface potential of the photosensitive body drum 1. In FIG. 2, other functional units generally required for an electro-photography process are unnecessary herein and thus omitted.

Toner used for the present invention is preferably non-magnetic toner. The reason is as follows: m an electro-photography process, toner cleaned after the transfer step must not contact in subsequent processes an electrification unit. However, if insufficiently-cleaned magnetic toner is used, this magnet-used electrification method cannot avoid a situation where magnets cause the magnetic toner to be attracted toward the electrification unit, resulting in a contaminated electrification unit which may cause a problem of uneven electrification. Thus, the use of nonmagnetic toner can minimize an uneven electrification.

Next, basic operation of an image forming apparatus of this magnetic-levitating electrification method will be described.

DC voltage feeding from a power pack 5 to a discharge electrode 2*a* levitating above the photosensitive body drum 1 allows the surface of the photosensitive body drum 1 to have even electrification with high electric potential. This is immediately followed by the irradiation of image light by exposure means 3 onto the surface of the photosensitive body drum 1 to cause the irradiated part of the photosensitive body drum 1 to have reduced electric potential. Such an electrification mechanism where the electrification apparatus 2 provides electrification to the surface of the photosensitive body drum 1 is known as a discharge in a micro gap between the electrification apparatus 2 and the photosensitive body drum 1 according to Pasehen's law.

An image light is a distribution of light amount according to an image generated. Thus, irradiation of such image light forms on the surface of the photosensitive body drum 1 the distribution of electric potential corresponding to a recorded image (i.e., electrostatic latent image). If such a part of the photosensitive body drum 1 on which an electrostatic latent image is formed passes the development roller 4, toner will adhere to the photosensitive body drum 1 depending on the level of the electric potential to form a toner image which is a visible image of the electrostatic image. A recording paper 7 is sent by a resist roller (not shown) with predetermined timing to such a part of the photosensitive body drum 1 on which the toner image is formed, and then the recording paper 7 is superposed on the toner image. Then, after this toner image is transferred by the transfer roller 6 to the recording paper 7, the recording paper 7 is separated from the photosensitive body drum 1. The separated recording paper 7 is transported via a transportation path and thermally fixed by a fixing unit (not shown) to be ejected from the apparatus. The photosensitive body drum 1 after being involved in the above transfer step has a surface cleaned by a cleaning apparatus 8 and has all the residual electric charge removed by a quenching lamp (not shown) so as to prepare for the next imaging processing.

According to the above image forming apparatus, the discharge electrode 2*a* of the electrification apparatus 2 is magnetically levitated and the vibration thereof is prevented, thereby making it possible that the discharge electrode 2*a* and the surface of the photosensitive body drum 1 are configured to have a micro gap therebetween across the full width of the photosensitive body drum 1 and ozone generation can be minimized to provide constant and uniform electrification. Moreover, the avoidance of the vibration of discharge electrode 2*a* eliminates the contact between the discharge electrode 2 and the surface of the photosensitive body drum 1 to prevent the short-circuiting of the discharge electrode 2*a* and the photosensitive body drum 1, so that the damage of the photosensitive body drum 1 can be avoided, thereby preventing negative effect such as image deterioration due to the damage of the photosensitive body drum 1. The avoidance of the vibration of the discharge electrode 2*a* also makes it possible not to use an abrasion-causing part such as a contact electrification unit, thereby providing an advantage of high durability.

EXAMPLE 1-1

In an image forming apparatus having an electrification unit, an exposure unit, a development unit, and a transfer unit around a photosensitive body drum, at an upper position in the inside of the photosensitive body drum, a first cuboid bar magnet having a width of 3 mm, a height of 8 mm, and a length of 320 mm was fixed such that a portion thereof having a magnetic flux density of 70 mT (milli-Tesla) had a width of 3 mm and that an N pole thereof was positioned upward. Moreover, in the outside of the photosensitive body drum, a second bar magnet having the same shape and magnetic flux density as those of the first bar magnet was positioned such that an N pole thereof was positioned downward. At this time, this second bar magnet had acrylic side plates along its longitudinal direction so that it could avoid inversion and lateral slip, and an upper portion of the second bar magnet was not necessary to have any support in particular.

Moreover, the lower end of the second bar magnet was attached to with a fine tungsten wire having a diameter of 20 $\mu$m $\phi$. This fine wire ran from the end of the second bar magnet to a high-voltage power supply unit via wiring.

The second bar magnet had a weight of 1.14 g/cm per unit length and had a homopolar repulsion with the first bar magnet, allowing is itself to be levitated at a distance of 6 mm from the first bar magnet. The weight of the wire was almost negligible and thus had no impact on the distance. The position of the first bar magnet was adjusted in the longitudinal direction so that the distance between a discharge electrode of the second bar magnet and the surface of the photosensitive body drum could be 0.1 mm.

In this layout, while the photosensitive body drum was rotated, DC voltage of 2 kV was applied to a space between the fine wire attached to the second bar magnet and the photosensitive body drum to generate a micro gap discharge that provided electrification to the surface of the photosensitive body drum, thereby preparing an image. The resulted image was prepared favorably and there was detected very little ozone odor such as found in corona electrification with a charging wire. Thereafter, the apparatus of this layout has operated for more than 30,000 cycles in good condition and showed no abnormality thereafter. Observation during discharging of corona lights in the darkness showed that this layout allowed the corona lights to sufficiently glow in static condition. The reason is that: Coulomb attraction between the electrification unit and the photosensitive body was exerted on the first and the second bar magnets, which were balance d in magnetic force and gravity. However, in this case, since the weight of the second bar magnet generated relatively large inertial force, this Coulomb attraction did not move the second magnet means.

COMPARISON EXAMPLE 1-1

In this layout of an image forming apparatus that was the same as that used in Example 1-1, a rotatable electrification roller was provided in an electrification unit. The electrification roller always contacted a photosensitive body drum. Due to the contact, repeated operation of the apparatus of this layout caused the electrification roller and the photosensitive body drum to abrade away and then, uneven electrification began to be generated when the operation cycles reached about 10,000, resulting in deteriorated image quality.

COMPARISON EXAMPLE 1-2

An electrification unit using the electrification roller of Comparison Example 1-1 was positioned slightly above a photosensitive body drum so that they did not contact each other. The end of the roller had a relatively large diameter in order to maintain the gap between the electrification unit and the roller, and contacted the photosensitive body drum. With this layout, image formation was repeated. When the operation cycles reached about 20,000, the end of the roller and the photosensitive body drum began to abrade away to show uneven electrification levels, resulting in deteriorated image quality.

COMPARISON EXAMPLE 1-3

In an image forming apparatus that was the same as that of the Example 1-1, an electrification unit was attached with a corona discharge housing according to a charging wire method. In this layout, whenever image formation was performed, strong ozone odor was generated even outside of the apparatus. Observation of corona lights in the darkness during discharging showed that this layout caused the corona lights to constantly vibrate.

Second Embodiment

Figure 6:
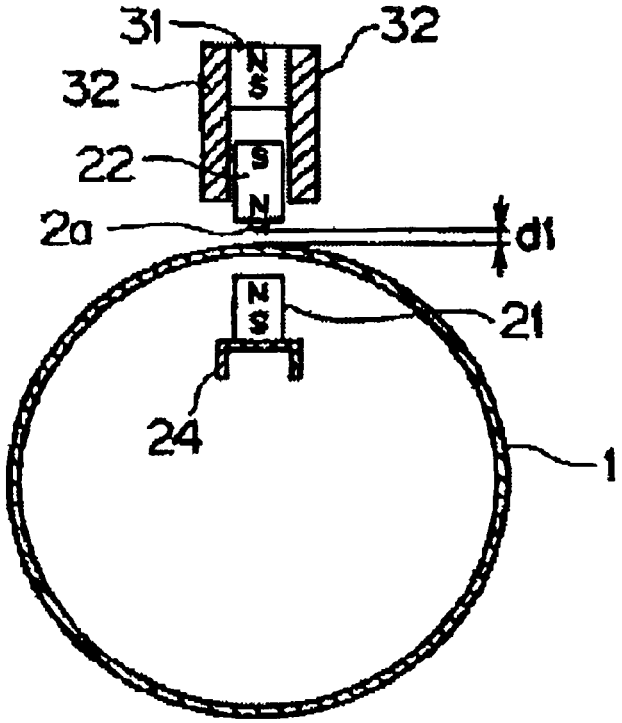
FIG. 6 is a side view showing an electrification apparatus of the second embodiment of the present invention.
Figure 7:
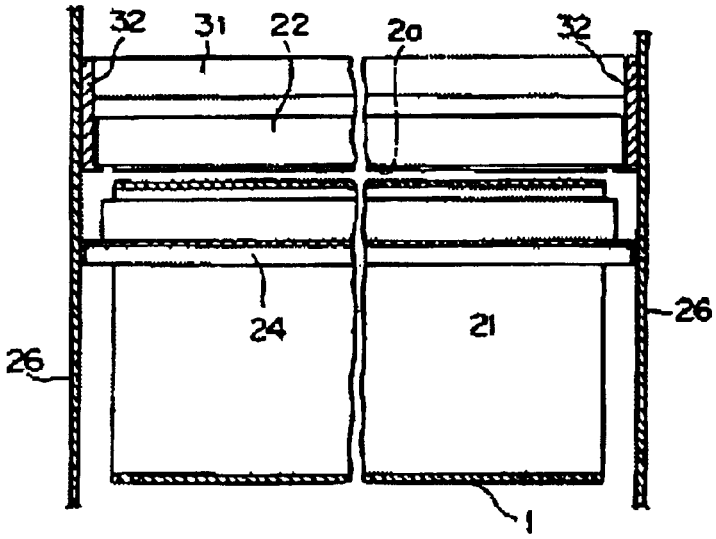
FIG. 7 is a sectional elevation view showing an electrification apparatus of the second embodiment of the present invention.
Figure 8:
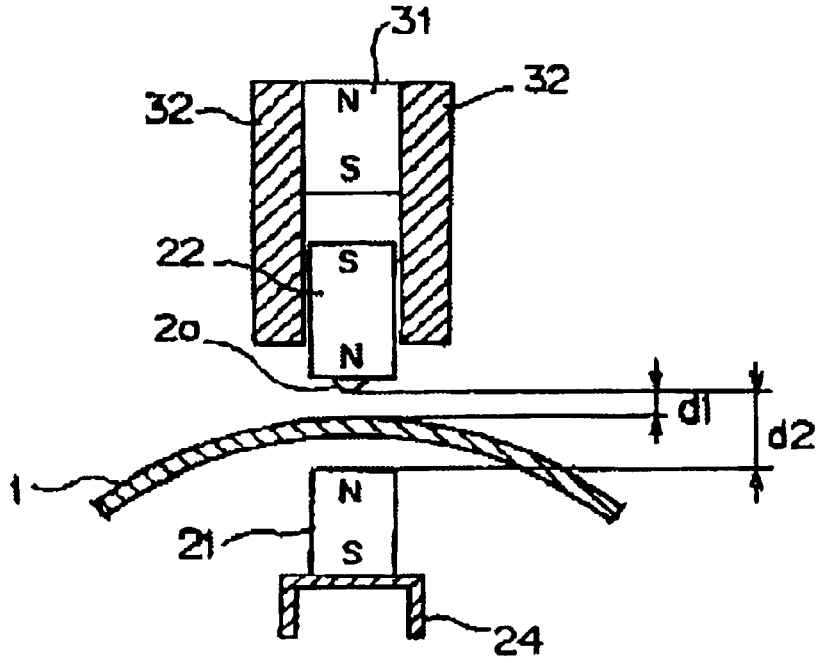
FIG. 8 is an enlarged section view of a main part of an electrification apparatus of FIG. 6.

FIG. 6 shows an electrification apparatus of the second embodiment of the present invention. In this electrification apparatus of the second embodiment, a repulsive force owing to the magnetic force acts on the direction in which a first magnet means and a second magnet means separate each other. That is, as shown in FIG. 6 to FIG. 8, a third magnet 31 is provided at the opposite side of the second magnet means 22 seen from the first magnet means 21 (i.e., the third magnet 31 and the first magnet means 21 have symmetry relation), so that a magnetic pole configuration can be provided where the second magnet means 22 and the first magnet means 21 separate from each other with the third magnet 31 provided therebetween.

Incidentally, the second magnet means 22 being levitated between the first magnet means 21 and the third magnet 31 cannot maintain its levitation without some guide or support provided at right angle with the levitation direction. Thus, in the electrification apparatus of the second embodiment, parallel side plates 32 are provided so as to sandwich the elongated second magnet means 22 with a predetermined micro gap, so that the photosensitive body drum 1 can guide or support in its axis direction the second magnet means 22. This layout allows the second magnet means 22 to slide with respect to the parallel side plates 32. These parallel side plates 32 are composed of one parallel side plate provided in the axis direction of the photosensitive body drum 1 and the other parallel side plate provided at right angle with the axis direction of the photosensitive body drum 1. Thus, the second magnet means 22 is regulated in displacement in both of axis direction and orthogonal direction of the photosensitive body dram 1.

In addition, since the parallel side plates 32 are provided in the vicinity of the discharge electrode 2*a* to which high voltage is applied, the parallel side plates 32 are made of insulator in order to avoid the short-circuiting of the discharge electrode 2*a* via the parallel side plate 32.

In the electrification apparatus of the second embodiment, in order to keep the most stable levitation of the second magnet means 22 in which the discharge electrode 2*a* is provided, the third magnet 31 provided above the second magnet means 22 is sandwiched by the parallel side plates 32 which are supports of the second magnet means 22, so that these three magnets of the first magnet means 21, the second magnet means 22, and the third magnet 31 are provided in a straight line in a vertical line to the photosensitive body drum 1.

Moreover, in order to allow the minute adjustment of the distance d1 which is a distance between the discharge electrode 2*a* and the photosensitive body drum 1, at least one of members to which the first magnet means 21 or the third magnet 31 are attached (i.e., parallel side plates 32 and 1, magnet support 24) can be provided with position adjustment means for changing the levitation distance between the second magnet means 22 and the photosensitive body drum 1. This layout can have an optimized distance dl between the discharge electrode 2*a* and the photosensitive body drum 1.

The third magnet 31 is also provided in the opposite direction of gravity to provide a balance between positive and negative directions of gravity, thereby levitating the second magnet means 22. Position of each magnet is selected such that homopolar magnets are opposed each other to have a balanced repulsion.

For example, one magnet has a pair of magnetic poles. When directions of opposite magnetic poles of [S•N] are assumed to be [S•N] or [N•S], mutually repulsing and balanced magnetic forces can be modeled as [S•N]⇆[N•S]⇆[S•N] (symbols ⇆ represent repulsive forces). That is, as shown in FIG. 8, when the magnetic pole of the first magnet means 21 is made as [S•N], the first magnet means 21 and the second magnet means 22 are provided such that the N pole of the first magnet means 21 is opposed to the N pole of the second magnet means 22 and the S pole of the second magnet means 22 is opposed to the S pole of the third magnet 31.

Furthermore, each magnet also can be provided such that different magnetic poles thereof are opposed each other so that they attract each other. In other words, the second magnet means 22, the first magnet means 21, and third magnet 81 can have a magnetic pole configuration in which they attract one another.

For example, mutually attracted magnetic poles can be modeled as [S•N]→←[S•N]→←[S•N] (symbols →← represent attraction force). In other words, when the magnetic pole of the first magnet means 21 is assumed to be [S•N], the first magnet means 21 and the second magnet means 22 are provided such that the N pole of the first magnet means 21 is opposed to the S pole of the second magnet means 22 and the N pole of the second magnet means 22 is opposed to the N pole of the third magnet 31.

Figure 9:
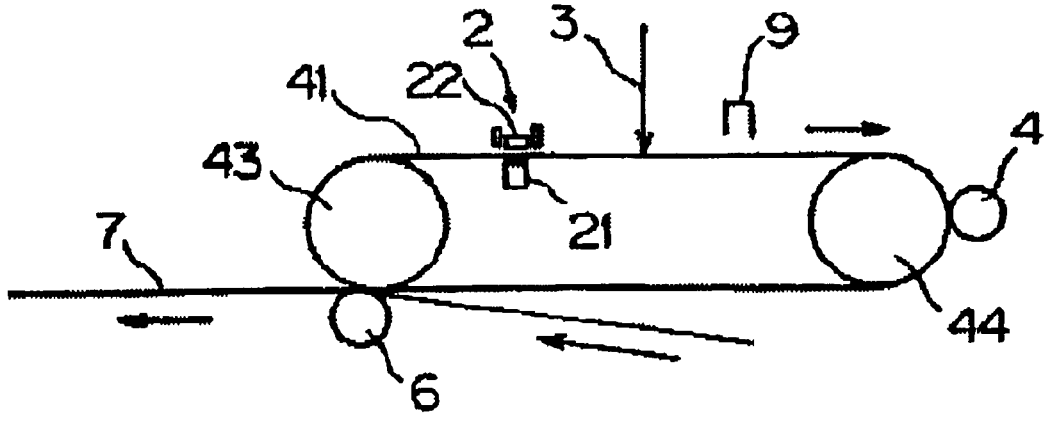
FIG. 9 is a schematic drawing of an image forming apparatus showing the third embodiment of the present invention.
Figure 10:
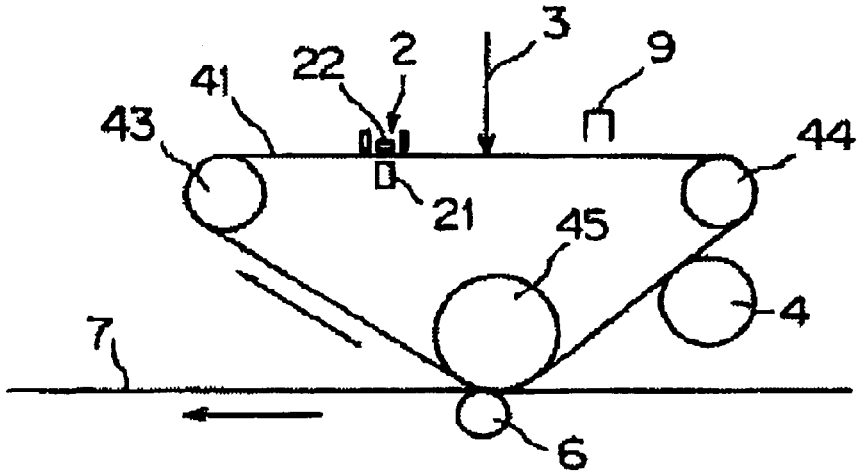
FIG. 10 is a schematic drawing of an image forming apparatus showing a modification of the third embodiment of the present invention.

In the electrification apparatus of the above second embodiment is described in a case where an image forming apparatus using the photosensitive body drum 1 is used. However, the electrification apparatus of the second embodiment also can be provided for an image forming apparatus using the photosensitive body belt 41 as shown in FIG. 9 and FIG. 10, for example.

According to the electrification apparatus of the second embodiment, in an electrification apparatus which provides electrification to the photosensitive body drum 1 or the photosensitive body belt 41 in accordance with electrophotography, such a structure is provided where; a photosensitive body base has therein a first magnet means 21; the photosensitive body base has a second magnet means 22 on the outer surface thereof; the first magnet means 21 and a third magnet 31 sandwich the second magnet means 22 with a symmetry configuration; a tip part of the second magnet means 22 that is faced with the outer surface of the photosensitive body has a discharge electrode 2*a* as discharge means; and a guide plate 32 is provided, which is non-magnetic-body-made guide means capable of moving the second magnet means 22 in one direction. This structure has a magnetic pole configuration where magnetic poles of the first, second, and third magnets 21, 22, and 31 are positioned such that the first magnet means 21 and the third magnet 31 can levitate the second magnet means 22 therebetween. Thus, this structure provides an effect where the electrification apparatus can keep a constant distance between the discharge electrode 2*a* provided on the second magnet means 22 and the photosensitive body drum 1 or the photosensitive body belt 41 by receiving a repulsive force or a gravitational force from the third magnet 31. This constant distance can be kept even if the electrification apparatus receives an external force that is exerted in a direction where the second magnet means 22 separates from the photosensitive body drum 1 or the photosensitive body belt 41.

Furthermore, the provision of the guide plates 32 that regulate the second magnet means 22 provides an effect where the elongated second magnet means 22 can be securely guided or supported in a rotational axis direction of the photosensitive body drum 1 or the photosensitive body belt 41.

In addition, the use of insulator material-made parallel side plates 32 which function as guide plate avoids the short-circuiting of the discharge electrode 2*a*, even if the discharge electrode 2*a* has some unexpected abnormality.

The above magnet configuration also provides an effect where optimized levitation of the second magnet means 22 can be securely kept because the three magnets are provided in a straight line and the third magnet 31 above the second magnet means 22 is sandwiched by the parallel side plates 32 so that these magnets are placed in the same direction as the one through which gravity works.

Moreover, at least one of members to which the first magnet means 21 or the third magnet 31 is attached can be provided with position adjustment means for changing the levitation distance between the second magnet means 22 and the photosensitive body drum 1 or the photosensitive body belt 41. This layout allows a minute adjustment of the distance between the discharge electrode 2*a* and the photosensitive body and provides an optimized distance dl between the discharge electrode 2*a* and the photosensitive body drum 1 or the photosensitive body belt 41.

EXAMPLE 2-1

An image forming apparatus having an electrification unit, an exposure unit, a development unit, a transfer unit and the like was employed:

(1) at an upper portion in the inside of the photosensitive body, a cuboid and bar magnet (a first magnet means) having a width of 3 mm, a height of 8 mm and a length of 320 mm was fixed such that a portion thereof having a magnetic flux density of 70 mT (milli-Tesla) had a width of 3 mm and that an N pole thereof was positioned upward;

(2) in the vicinity of the photosensitive body, a bar magnet (a second magnet means) having the same magnetic flux density as that of the first magnet means was positioned such that an N pole thereof was positioned downward; and (3) above the second magnet means, a bar magnet (a third magnet) having the same magnetic flux density as that of the second magnet means was positioned such that an S pole thereof was positioned downward.

Moreover, the lower end of the second bar magnet was attached with a tungsten fine wire having a diameter of 20 μm ϕ□as a discharge electrode. This fine wire ran from the end of the second bar magnet to a high-voltage power supply unit via wiring. The second magnet means had a weight of 1.14 g/cm per unit length and had homopolar repulsion with the first and third magnets, allowing it to be levitated at a distance of 6 mm from the first and third magnets. The weight of the fine wire was almost negligible and thus had no impact on the distance. The position of the first bar magnet was adjusted in the longitudinal direction so that the distance between the second magnet means and the surface of the photosensitive body could be 0.1 mm.

In this layout while the photosensitive body drum was rotated, DC voltage of 2 kV was applied to a space between the fine wire attached to the second magnet means and the photosensitive body to generate a micro gap discharge that provided electrification to the surface of the photosensitive body, thereby preparing an image.

The resulted image was prepared favorably and there was detected very little ozone odor such as found in corona electrification with charging wire. The apparatus of this layout has operated for more than 30,000 cycles in good condition and showed no abnormality thereafter. Observation of corona lights in the darkness during discharging showed that this layout allowed the corona lights to sufficiently glow in static condition.

The reason is that: Coulomb attraction between the electrification unit and the photosensitive body was exerted on the first and the second bar magnets, which were balanced in magnetic force and gravity. However, in this case, since the weight of the magnet generated relatively large inertial force, this Coulomb attraction did not move the magnet.

COMPARISON EXAMPLE 2-1

In the layout of an image forming apparatus of Example 2-1, in an electrification unit, a rotatable electrification roller was provided in place of the electrification apparatus of Example 2-1. The electrification roller always contacted a photosensitive body drum. Due to the contact, repeated operation of the apparatus of this layout caused the electrification roller and the photosensitive body drum to abrade away and then uneven electrification began to be generated when the operation cycles reached about 10,000, resulting in deteriorated image quality.

COMPARISON EXAMPLE 2-2

An electrification unit using the electrification roller of Comparison Example 2-1 was positioned slightly above a photosensitive body drum so that they did not contact each other. The end of the roller had a relatively large diameter in order to maintain the gap between the electrification unit and the roller, and contacted the photosensitive body drum. With this layout, image formation was repeated. When the operation cycles reached about 20,000, the end of the roller and the photosensitive body drum began to abrade out to show uneven electrification levels, resulting in deteriorated image quality.

COMPARISON EXAMPLE 2-3

In an image forming apparatus of Example 2-1, in place of the electrification apparatus of Example 2-1, a corona discharge housing according to a charging wire method was attached to an electrification unit. In this layout, whenever image formation was performed, strong ozone odor was generated even outside of the apparatus. Observation of corona lights in the darkness during discharging showed that this layout caused the corona lights to constantly vibrate.

[Third Embodiment]

FIG. 9 shows an outline of an image forming apparatus of a third embodiment of the present invention.

FIG. 10 shows an outline of an image forming apparatus showing a modification of the third embodiment of the present invention.

As shown in FIG. 9, an image forming apparatus of the third embodiment employs a photosensitive body belt 41 which is an endless belt-shaped flexible photosensitive body. In this image forming apparatus, an electrification apparatus 2 that is the same as that used in Example 1-1 is provided on a horizontal portion of the photosensitive body belt 41 which is rotationally driven by the tension by a driving is roller 43 and a driven roller 44.

An image forming apparatus shown in FIG. 10 is an example of another layout of the image forming apparatus of FIG. 9. In this image forming apparatus of FIG. 10, in addition to the driving roller 43 and the driven roller 44, a tension roller 45 is provided for providing tension to the photosensitive body belt 41 so that the photosensitive body belt 41 can avoid flexure or torsion. This tension roller 45 performs image transfer to a recording paper 7 which is a transfer paper. In this case, the electrification unit also can be positioned above the photosensitive body belt as with FIG. 9.

In the image forming apparatuses using these photosensitive body belts, for magnetically levitated electrification, it is desirable that a gravity flux line and a magnetic force line of a fixed magnet are made parallel so that the flux line has N and S poles of a levitating magnet. For a cylinder-shaped photosensitive body, positions that can satisfy the above conditions are only the bottom part and the top part of the cylinder. However, such a cylinder-shaped photosensitive body also can have a wide region that has positioned in parallel gravity flux line and a magnetic force line of a fixed magnet by using a flexible belt-shaped photosensitive body that allows it to have a broader horizontal surface. This layout allows a designer to more freely determine the position of a magnetically levitated electrification unit and thus overall layout. The belt-shaped photosensitive body allows itself to be driven by the driving roller holding the photosensitive body, thereby eliminating the need for a special rotational driving apparatus such as a cylinder-shaped rigid photosensitive body.

Moreover, the above levitation electrification method allows an electrification unit to be cleaned easily if the unit becomes tainted by detaching the unit for cleaning, thereby making maintenance processes such as cleaning easier.

Furthermore, in this image forming apparatus characterized in that the photosensitive body belt is driven by at least two rollers and the electrification unit thereof receives tension in horizontal direction, the photosensitive body belt receiving tension by the two rollers can keep a part of the circumference thereof in horizontal direction.

Thus, a gravity flux line and a flux line of a fixed magnet can be set parallel on any position of a fixed side-magnet on region in the photosensitive body belt, the position being parallel to the circumference direction of the belt between the rollers.

The above image forming apparatus is also characterized in that a photosensitive body region which horizontally moves with the photosensitive body belt is disposed by a fixed side-magnet that is not associated with a driving force by the photosensitive body and a levitating side-magnet that is levitating by having repulsion to the fixed side-magnet. The position of the fixed magnet provided inside of the photosensitive body belt can be set at any position as long as the fixed magnet does not contact the roller.

EXAMPLE 3-1

An image forming apparatus was employed, which had a flexible photosensitive body belt which receives tension by two rollers of a driving roller and a driven roller so that the belt could be horizontally stretched. Around the flexible photosensitive body belt, an electrification unit, an exposure unit, a development unit, and a transfer unit were provided. At an upper portion in the inside of the photosensitive body belt, a first cuboid bar magnet having a width of 8 mm, a height of 8 mm, and a length of 320 mm was fixed such a portion thereof having a magnetic flux density of 70 mT (milli-Tesla) has a width of 3 mm and that an N pole thereof was positioned upward. In this layout, positioned outside of the photosensitive body belt was a second bar magnet that had the same shape and the magnetic flux density as those of the first bar magnet, with the N pole being positioned downwardly (see FIG. 9).

At this time, this second bar magnet had acrylic side plates along its longitudinal direction so that it could avoid inversion and lateral slip and any support was not necessary at the upper end thereof. The lower end of the second bar magnet was attached with a tungsten fine wire having a diameter of 20 $\mu$m $\phi$. This fine wire ran from the end of the second bar magnet to a high-voltage power supply unit via wiring. The second bar magnet had a weight of 1.14 g/cm per length unit and had a homopolar repulsion with the first bar magnet, allowing itself to be levitated at a distance of 6 mm from the first bar magnet. The weight of the wire was almost negligible and thus had no impact on the distance. The position of the first bar magnet was adjusted in the longitudinal direction so that the distance between a discharge electrode of the second bar magnet and the surface of the photosensitive body drum could be 0.1 mm.

In this layout, while the photosensitive body belt was rotated, DC voltage of 2 kV was applied to a space between the wire attached to the second bar magnet and the photosensitive body belt to generate a micro gap discharge that provided electrification to the surface of the photosensitive body drum, thereby preparing an image. The resulted image was favorable and there was detected very little ozone odor such as found in corona electrification with a charging wire.

This layout was modified by shifting the position of the electrification unit back and forth in the belt horizontal region. Targeted electrification of this modified layout was set to be 800 V. Voltage application to this modified layout resulted in fluctuation of the targeted electrification within ±5%, showing completely no difference in the shading of the image. The apparatus of this layout has operated for more than 30,000 cycles in good condition and showed no abnormality thereafter.

Observation of corona lights in the darkness during discharging showed that this layout allowed the corona lights to sufficiently glow in static condition. The reason is that: Coulomb attraction between the electrification unit and the photosensitive body was exerted on the first and the second bar magnets, which were balanced in magnetic force and gravity. However, in this case, since the weight of the magnet generated relatively large inertial force, this Coulomb attraction did not move the magnet.

EXAMPLE 3-2

An image forming apparatus was employed, which had a flexible photosensitive body belt that received tension by three rollers of a driving roller, a driven roller, and a driven tension roller for applying tension in downward direction so that the belt could be stretched. An electrification unit, an exposure unit, a development unit, and a transfer unit were provided around the flexible photosensitive body belt. In this image forming apparatus, at an upper position in the inside of the photosensitive body belt region stretched in horizontal direction, a first cuboid and bar magnet having a width of 3 mm, a height of 8 mm, and a length of 320 mm was fixed such that a portion thereof having a magnetic flux density of 70 mT (milli-Tesla) had a width of 3 mm and that an N pole thereof was positioned upward. Moreover, in the outside of the photosensitive body belt, a second bar magnet having the same shape and magnetic flux density as those of the first bar magnet was positioned such that an N pole thereof was positioned downward (see FIG. 10).

This second bar magnet had, along its longitudinal direction, injection molded and acrylic cuboid side plates on which holes were provided, so that the second bar magnet could avoid inversion and lateral slip and had no support at the upper end thereof in particular. The lower end of the second bar magnet was attached with a tungsten fine wire having a diameter of 20 $\mu$m $\phi$. This fine wire ran from the end of the second bar magnet to a high-voltage power supply unit via wiring. The second bar magnet had a weight/unit length of 1.14 g/cm and had a homopolar repulsion with the first bar magnet, allowing itself to be levitated at a distance of 6 mm from the first bar magnet. The weight of the wire was almost negligible and thus had no impact on the distance. The position of the first bar magnet was adjusted in the longitudinal direction so that the distance between a discharge electrode of the second bar magnet and the surface of the photosensitive body could be 0.1 mm. In this layout, while the photosensitive body belt was rotated, DC voltage of 2 kV was applied to a space between the fine wire attached to the second bar magnet and the photosensitive body belt to generate a micro gap discharge that provides electrification to the surface of the photosensitive body drum, thereby preparing an image. The resulted image was prepared favorably and there was detected very little ozone odor such as found in corona electrification with a charging wire.

This layout was modified by shifting backward and forward the position of the electrification unit in the belt horizontal region. Targeted electrification of this modified layout was set to be 800 V. Voltage application to this modified layout resulted in fluctuation of the targeted electrification within ±5%, showing completely no difference in the shading of the image. The apparatus of this layout was operated for more than 30,000 cycles in good condition and showed no abnormality thereafter.

Observation of corona lights in the darkness during discharging showed that this layout allowed the corona lights to sufficiently glow in static condition. The reason is that: Coulomb attraction between the electrification unit and the photosensitive body was exerted on the first and the second bar magnets, which were balanced in magnetic force and gravity. However, in this case, since the weight of the magnet generated relatively large inertial force, this Coulomb attraction did not move the magnet.

COMPARISON EXAMPLE 3-1

In the image forming apparatus of Example 3-1, a rotatable electrification roller was provided in the electrification unit in place of the electrification apparatus of Example 3-1. The electrification roller always contacted the photosensitive body. Due to the contact, repeated operation of the apparatus of this layout caused the electrification roller and the photosensitive body to abrade out and then uneven electrification began to be generated when the operation cycles reached about 10,000, resulting in deteriorated image quality.

COMPARISON EXAMPLE 8-2

An electrification unit using the electrification roller of Comparison Example 3-1 was positioned slightly above a photosensitive body so that they did not contact each other. The end of the roller had a relatively large diameter to maintain the gap between the electrification unit and the roller, and contacted the photosensitive body drum. With this layout, image formation was repeated. When the operation cycles reached about 20,000, the end of the roller and the photosensitive body drum began to abrade to show uneven electrification levels, resulting in deteriorated image quality.

COMPARISON EXAMPLE 8-3

In an image forming apparatus that was the same as that of Example 3-1, as a substitute of the electrification apparatus of Example 3-1, an electrification unit was attached with a corona discharge housing according to a charging wire method. In this layout, whenever image formation was performed, strong ozone odor was generated even outside of the apparatus. Observation of corona lights in the darkness during discharging showed that this layout caused the corona lights to constantly vibrate.

Fourth Embodiment

Figure 11A:
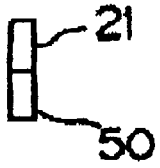
FIG. 11(A) is a side view thereof and FIG. 11(B) is an elevation view thereof
Figure 11B:
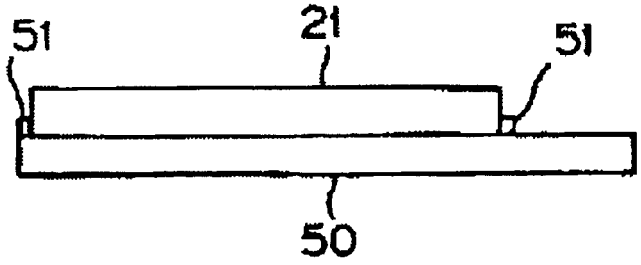

FIG. 11 shows an electrification apparatus showing the fourth embodiment of the present invention.

The electrification apparatus of the fourth embodiment has the same structure as that shown in the first embodiment in FIG. 1 except for the fixed side-magnet.

As shown in FIG. 11, a first magnet means 21 that is a fixed side-magnet used for this electrification apparatus has a magnetic body 50 closely attached on the entire face which is the other side of the face opposed to a second magnet means 22. As this magnetic body 60, a magnetic body such as paramagnetic body and ferromagnetic body may be used. A projection-shaped catching unit 51 for regulating position shift of the first magnet means 21 is formed on a face of the magnetic body 50 on which the first magnet means 21 is closely attached. This catching unit 51 may be omitted, The magnetic body 50 may be used in place of a first magnet means support body 24.

In the second magnet means 22 levitated by the fixed side-first magnet means 21, a magnetic pole on the lower end of the first magnet means 21 (i.e., a magnetic pole that is opposite to a magnetic pole that is opposed to the second magnet means 22) generates a heteropolar magnetic flux. If the distance between an N pole and an S pole of the magnet cannot be sufficiently spaced, this heteropolar magnetic flux leaks and this may cause the stable levitation of the second magnet means 22 to be disturbed.

That is, the leaked magnetic flux generates attractive or repulsive force which generates moment on the levitating second magnet means 22, thereby disturbs the stable levitation.

The electrification apparatus according to the fourth embodiment is designed to suppress the generation of this leakage of magnetic flux so that the levitating side-second magnet means 22 can more stably levitated to provide uniform electrification, thereby enabling favorable images.

Figure 12A:
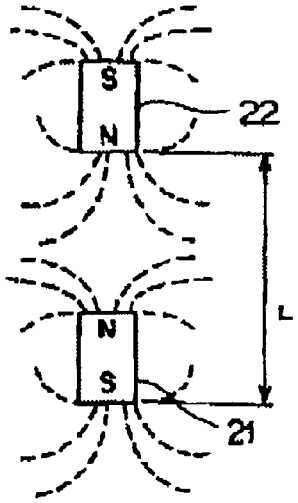
FIG. 12 is a view showing principles of an electrification apparatus of the fourth embodiment of the present invention.
Figure 12B:
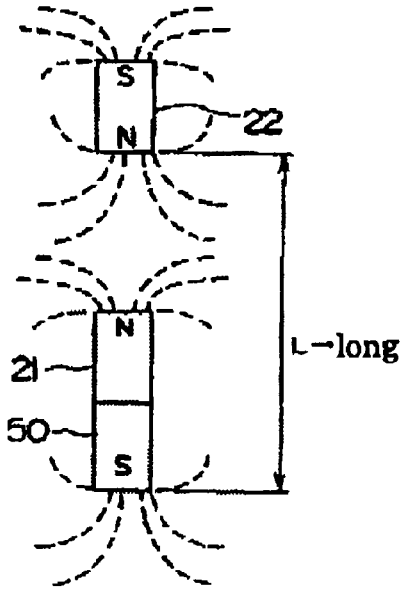

The fixed side-first magnet means 21 is firmly attached on the first magnet means support body 24 for maintaining and positioning the is first magnet means 21. This first magnet means support body 24 as a fixation member is made of magnetic body 50 so that this magnetic body 50 can move the magnetic pole that is opposite to the levitating side-magnetic pole of the first magnet means 21 (i.e., lower magnetic pole) toward an end face that is more distant from the second magnet means 22 (see FIGS. 12(A) and 12(B)).

In this phenomenon, the distance L between the N pole and the S pole of the first magnet means 21 is long. That is, this phenomenon provides the same effect as the one gained when the distance between the magnetic pole on the lower end of the second magnet means 22 and the magnetic pole on the lower end of the first magnet means 21 is long. Thus, the rotation moment of a levitating magnet caused by leaked magnetic flux can be decreased to provide more stable levitation, thereby providing uniform electrification and thus favorable images.

According to this structure, heteropolar magnetic flux generated from the opposite side of the second magnet means 22 side of the first magnet means 21 moves toward an end face of the magnetic body 60 that is more distant from the first magnet means 21 that is closely attached to the first magnet means 21. Thus, this structure is effective to suppress the moment on the levitating second magnet means 22 that is caused by attractive or repulsive force generated by the leaked magnetic flux, thereby providing more stable levitation.

The structure of the above electrification apparatus can be further simplified by setting the magnetic body 50 as a first magnet means support 24 that regulates or adjusts the distance between the discharge electrode 2*a* of the levitating second magnet means 22 and a photosensitive body. Also, this use of the magnetic body 50 as a first magnet means support body 24 will not make the longitudinal location space to be increased.

EXAMPLE 4-1

In an image forming apparatus having an electrification unit, an exposure unit, a development unit, and a transfer unit around a photosensitive body drum, at an upper position in the inside of the photosensitive body drum, a first cuboid bar magnet having a width of S mm, a height of 8 mm and a length of 320 mm was fixed such that a portion thereof having a magnetic flux density of 70 mT (milli-Tesla) had a width of 3 mm and that an N pole thereof was positioned upward. Moreover, in the outside of the photosensitive body drum, a second bar magnet having the same shape and magnetic flux density as those of the first bar magnet was positioned such that an N pole thereof was positioned downward. This second bar magnet was set in rectangular frame-shaped side plates having penetration apertures, with the bottom faces of the side plates 1 mm above the bottom face of the levitating second bar magnet, so that the second magnet means could avoid inversion and lateral slip. These side plates were made by injection molded-ABS resin and providing the apertures with the width of 3.1 mm. This second magnet means had no particular support at the upper end.

The lower end of the second bar magnet was attached with a tungsten fine wire having a diameter of 20 $\mu$m. This fine wire was provided such that the wire on the second bar magnet region was made open wire and the part of the wire from the ends of the second bar magnet to a plug connected with a high-voltage power supply unit was insulation-coated. This lead wire was connected to the high-voltage power supply unit such that the wire was slightly sagged.

The second bar magnet had a weight per unit length of 1.14 g/cm and had a homopolar repulsion with the first bar magnet, allowing itself to be levitated at a distance of 6 mm from the first bar magnet. The weight of the wire was almost negligible and thus had no effect on the distance. The lower surface of the first bar magnet was provided with a paramagnetic body having the same area as that of the bottom face of the first bar magnet and the height of 5 mm. This paramagnetic body and the first bar magnet were closely attached due to a magnetic force between them. Further prevention of position shift of the two members was allowed by providing the end of the contact face with a stepped portion to make them difficult to move. The position of the first bar magnet was adjusted in the longitudinal direction so that the distance between a discharge electrode of the second bar magnet and the surface of the photosensitive body could be 0.1 mm.

In this layout, while the photosensitive body was rotated, DC voltage of 2 kV was applied between the discharge electrode composed of a fine wire attached to the second bar magnet and the photosensitive body drum to generate a micro gap discharge that provided electrification to the surface of the photosensitive body, thereby producing an image.

Detection using an electrification electrometer of the surface electric potential at the center, left and right positions showed the surface electric potential within 800 V±50 V. There was no uneven electrification. The resulted image showed favorable imaging properties and there was detected very little ozone odor such as found in corona electrification with a charging wire. The apparatus of this layout has operated for more than 30,000 cycles in good condition and showed no abnormality thereafter. Observation of corona light in the darkness during discharge showed that the corona light glowed in static and good condition. The reason is that: Coulomb attraction between the electrification unit and the photosensitive body was exerted on the first and the second bar magnets, which were balanced in magnetic force and gravity. However, in this case, since the weight of the magnet generated relatively large inertial force, this Coulomb attraction did not move the magnet.

Fifth Embodiment

Figure 13A:
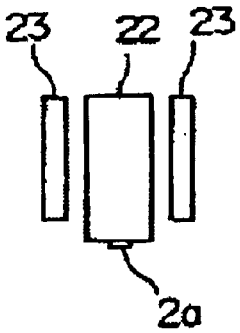
FIG. 13(A) is a side view thereof and FIG. 13(B) is an elevation view thereof.
Figure 13B:
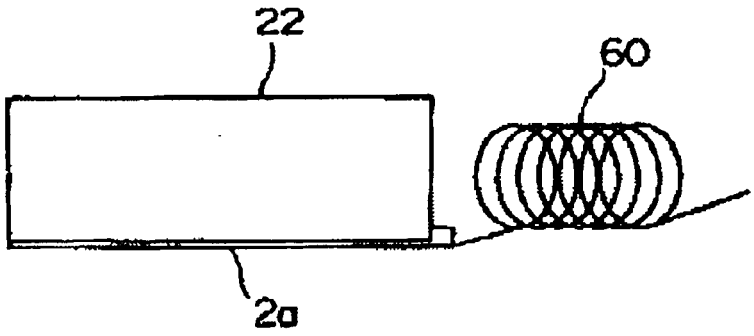

FIG. 13 shows an electrification apparatus of the fifth embodiment of the present invention.

The electrification apparatus of the fifth embodiment is a modification of the electrification apparatus shown in FIG. 1 in that: as shown in FIG. 13, in the electrification apparatus of the first embodiment, a flexible conductor 60 for applying discharge voltage is drawn from one end part of the discharge electrode 2*a* that is provided at the lower end of the levitating second magnet means 22. The flexible conductor 60 is a thin wire and thus is light weight and flexible. Coil configuration as shown in FIG. 13 is particularly favorable for the flexible conductor 60. The surface of the flexible conductor 60 is desirably coated with an insulating film.

The other end of the flexible conductor 60 is pin-shaped and a connection unit of a power supply unit for discharge is a female hole, into which the pin-shaped end can be inserted.

Since the flexible conductor 60 is a thin wire and thus is light weight and flexible, very little tension is exerted from the flexible conductor 60 to the levitating second magnet means 22 and discharge electrode 2*a*.

As described above, the very little tension from the flexible conductor 60 to the levitating second magnet means 22 and discharge electrode 2*a* allows the second magnet means 22 with a discharge electrode 2*a* to stably levitate to avoid the fluctuation of the discharge distance, thereby providing a uniform electrification.

EXAMPLE 5-1

In an image forming apparatus having an electrification unit, an exposure unit, a development unit, and a transfer unit around a photosensitive body drum, at an upper position in the inside of the photosensitive body drum, a first cuboid bar magnet having a width of 3 mm, a height of 8 mm, and a length of 320 mm was fixed such that a portion thereof having a magnetic flux density of 70 mT (milli-Tesla) had a width of 3 mm and that an N pole thereof was positioned upward. Moreover, in the outside of the photosensitive body drum, a second bar magnet having the same shape and magnetic flux density as those of the first bar magnet was positioned such that an N pole thereof was positioned downward. This second bar magnet is set in rectangular frame-shaped side plates having penetration apertures, with the bottom faces of the side plates 1 mm above the bottom face of the levitating magnet, so that the second bar magnet can avoid inversion and lateral slip. These side plates are made of injection molded-ABS resin and by providing the apertures with the width of 3.1 mm. This second bar magnet has no particular support at the upper end.

The lower end of the second bar magnet was attached with a tungsten fine wire having a diameter of 20 $\mu$m. This fine wire was provided such that the wire on the second bar magnet region was made open wire and the part of the wire from the ends of the second bar magnet to a plug connected with a high-voltage power supply unit was insulation-coated. This lead wire was connected to the high-voltage power supply unit such that the wire was slightly sagged.

The second bar magnet had a weight per unit length of 1.14 g/cm and had a homopolar repulsion with the first bar magnet, allowing itself to be levitated at a distance of 6 mm from the first bar magnet. The weight of the wire was almost negligible and thus had no impact on the distance. The position of the first bar magnet was adjusted in the longitudinal direction so that the distance between a discharge electrode of the second bar magnet and the surface of the photosensitive body could be 0.1 mm.

In this layout, while the photosensitive body was rotated, DC voltage of 2 kV was applied between the discharge electrode composed of a fine wire attached to the second bar magnet and the photosensitive body drum to generate a micro gap discharge which provided electrification to the surface of the photosensitive body, thereby producing an image.

Detection using an electrification electrometer of the surface electric potential at the center, left and right positions showed the surface electric potential within 800 V±50 V. There was no uneven electrification. The resulted image showed favorable imaging properties and there was detected very little ozone odor such as found in corona electrification with a charging wire. The apparatus of this layout has operated for more than 30,000 cycles in good condition and showed no abnormality thereafter. Observation of corona light in the darkness during discharge showed that the corona light glowed in static and good condition. The reason is that: Coulomb attraction between the electrification unit and the photosensitive body was exerted on the first and the second bar magnets, which were balanced in magnetic force and gravity. However, in this case, since the weight of the magnet generated relatively large inertial force, this Coulomb attraction did not move the magnet.

EXAMPLE 5-2

As with Example 5-1, in an image forming apparatus having a photosensitive body around which an electrification unit, an exposure unit, a development unit, and a transfer unit were provided, in the inner side of the photosensitive body, the lead wire unit of Embodiment 5-1 with coil-shaped ten windings and a diameter of about 5 mm was provided.

Detection using an electrification electrometer of the surface electric potential at the center, left and right positions showed the surface electric potential. Within 800 V±40 V. There was no uneven electrification. The resulted image showed favorable imaging properties as those shown in the above embodiment.

COMPARISON EXAMPLE 5-1

When the lead wire unit in the image forming apparatus of Example 5-1 was tightly stretched, the levitating magnet was drawn by the lead wire unit to collide with the side plates. Application of electrification resulted in more than 150 V of electric potential difference between the left and right parts.

Sixth Embodiment

Figure 14:
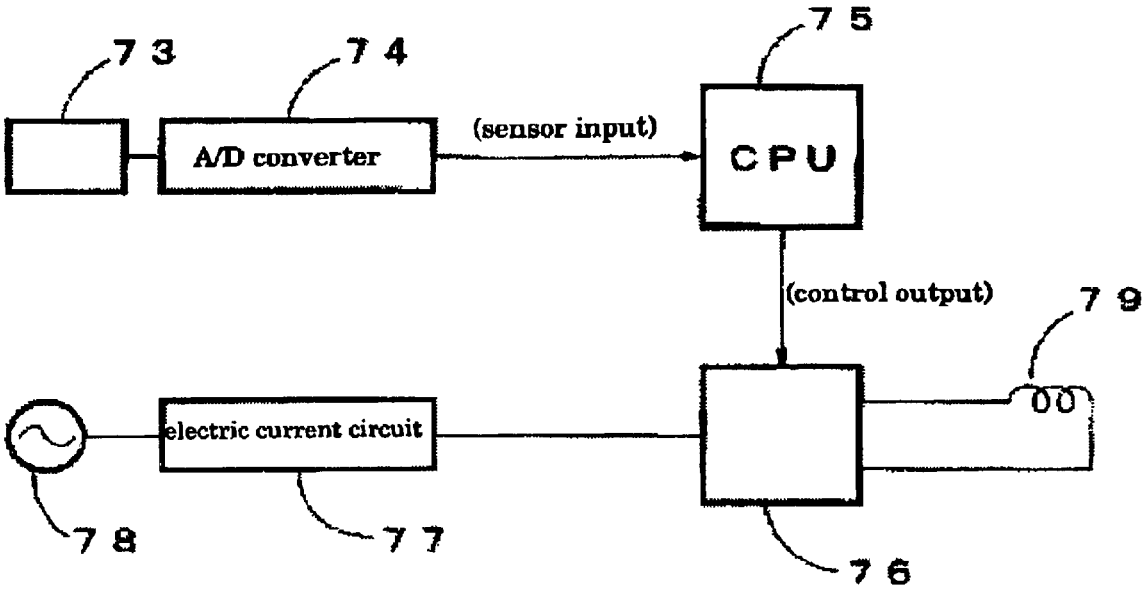
FIG. 14 is a view showing a control apparatus of the sixth embodiment of the present invention.

Although the above embodiment uses permanent magnet, electromagnet may be used in place of permanent magnet. In this embodiment, electromagnet 79 is used as a second magnet means 22. In the illustration of FIG. 14, an electromagnet is illustrated with coil only and the iron core thereof is omitted.

As shown in FIG. 14, this control apparatus includes; a gap sensor 73 for measuring the gap between a discharge electrode and a photosensitive body surface; A/D converter 74 for converting the measured analog value into digital value; a CPU 75 for inputting the converted digital value to output control signals; a current control unit 77 for controlling the current supplied to a coil 79 based on the control signals; and a power supply 78 connected to the current control unit 77 via a rectification circuit.

Figure 15:
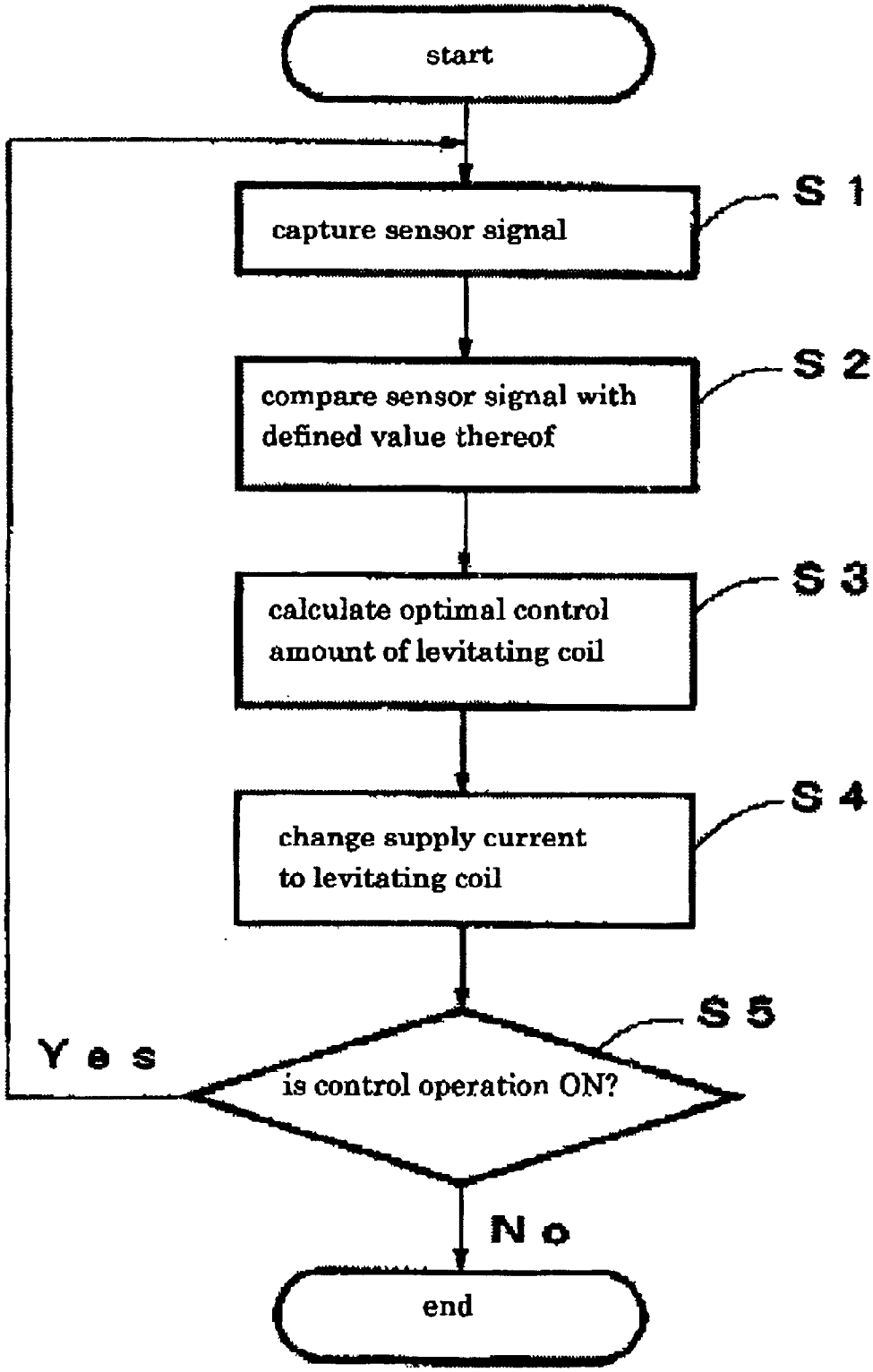
FIG. 15 is a view showing a control flowchart of the sixth embodiment of the present invention.

As shown in FIG. 15, the control flow of this control apparatus is composed of: step S1 for capturing a sensor signal; step S2 for comparing the sensor signal and a defined value of the sensor signal; step S3 for calculating the optimal control amount of the coil 79 of an electromagnet that is a levitating coil (i.e., fixed magnet); step S4 for changing a supply current to the levitating coil; and step S5 for determining whether the control operation is ON or not. The use of such a control apparatus provides accurate control of the fluctuation of the distance between a discharge electrode and a photosensitive body surface, thereby enabling constant and stable discharge gap.

The present invention is not limited to the above examples or embodiments. For example, in the above embodiment, a magnet as a fixed side-magnet is configured inside of a photosensitive body drum. However, in place of the magnet, the surface side of the base body of a photosensitive body drum may be magnetized to be the same magnetic pole as that of the levitating second magnet means opposed to the surface side.

Although in the above examples support side plates as regulation means were used, the regulation means is not limited to plate-shaped side plates. The support side plates may be bar-shaped, line-shaped, or block-shaped. That is, the support side plates may be variously modified within the scope and spirit of the present invention.

Effect of the Invention

As described above, the present invention avoids the vibration of a discharge electrode to reduce the gap between the discharge electrode and a photosensitive body, providing reduced ozone generation and uniform electrification of the photosensitive body.

Moreover, since it is possible to levitate the discharge electrode, non-contact electrification is also possible, which avoids the abrasion due to the contact therebetween to eliminate the fluctuation of a gap due to the abrasion, thereby providing an effect that durability against repeated operation is drastically improved.

Also, the present invention can avoid the rotation of a second magnet means to allow the second magnet means to keep levitation condition with a constant distance.

Also, the present invention can avoid the fluctuation of the levitating second magnet means to provide uniform discharge.

The present invention can easily levitate the second magnet means.

Constant intensity of electrification of an electrification unit requires minute adjustment of the distance between the photosensitive body surface and the second magnet means. Elevation means can longitudinally move the first magnet means to adjust the intensity of the electrification.

Moreover, the present invention uses nonmagnetic toner and thus provides an image forming apparatus that can avoid uneven electrification.

What is claimed is:

1. An electrification apparatus for providing electrification to a photosensitive body in an electro-photography, comprising:

a first magnet including a magnetized base body obtained by magnetizing a base body of the photosensitive body or a magnet provided inside of the base body of the photosensitive body;

a second magnet disposed outside the photosensitive body for opposing to said first magnet with a space to be magnetically levitated by said first magnet; and a discharge electrode attached to a face of the second magnet opposed to a surface of the photosensitive body, the discharge electrode being arranged with a predetermined distance from the photosensitive body surface and being configured to electrify the photosensitive body surface, wherein said space between the first and second magnets is adjusted by changing an intensity of magnetic poles of the first and second magnets to adjust the distance between the discharge electrode and the photosensitive body.

2. The electrification apparatus according to claim 1, wherein the second magnet includes regulation means for regulating a magnetic pole direction of the second magnet and a magnetic pole direction of the first magnet so that these directions are not deviated from each other.

3. The electrification apparatus according to claim 1 wherein the photosensitive body has one opening at least one end thereof, and a support member is provided via the opening for fixedly supporting the first magnet against a rotation of the photosensitive body.

4. The electrification apparatus according to claim 3, wherein the first magnet is configured on a vertical line running through a rotation axis of the photosensitive body.

5. The electrification apparatus according to claim 4, wherein the first magnet is attached to elevation means.

6. An image forming apparatus, comprising:

a development agent for developing a latent image on a photosensitive body: and an electrification apparatus including a first magnet including a magnetized base body obtained by magnetizing a base body of the photosensitive body or a magnet provided inside the base body of the photosensitive body, a second magnet magnetically levitated outside the photosensitive body by said first magnet, and a discharge electrode attached to a face of the second magnet opposed to a surface of the photosensitive body, the discharge electrode being spaced with a predetermined distance from the photosensitive body surface, wherein a non-magnetic toner is used for said development agent.

* * * * *